United States Patent [19]

Parente et al.

[11] Patent Number: 4,591,157

[45] Date of Patent: May 27, 1986

[54] GOLF CLUB SHAFT

[75] Inventors: Richard E. Parente, Palm Springs; Richard De LaCruz, Pauma Valley, both of Calif.

[73] Assignee: Callaway Hickory Stick-USA, Inc., Carlsbad, Calif.

[21] Appl. No.: 646,831

[22] Filed: Sep. 4, 1984

Related U.S. Application Data

[63] Continuation-in-part of Ser. No. 386,931, Jun. 10, 1982, Pat. No. 4,470,600.

[51] Int. Cl.[4] ..... A63B 53/02; A63B 53/10

[52] U.S. Cl. ..... 273/80 B; 273/80.2

[58] Field of Search ..... 273/80 R, 80 A, 80 B, 273/80 C, 80 D, 80.2–80.9, 77 R, 77 A, 81 B

[56] References Cited

U.S. PATENT DOCUMENTS

| | | | |
|---|---|---|---|
| 370,911 | 10/1887 | Weber | 273/68 |
| 649,146 | 5/1900 | Tice | 273/80 B |
| 772,043 | 10/1904 | Kleinschmidt | 408/11 |
| 1,007,668 | 11/1911 | Barrows | 273/68 |
| 1,513,350 | 10/1924 | Stolle | 408/59 |
| 1,522,321 | 1/1925 | Nyhagen | 273/68 |
| 1,541,736 | 6/1925 | Overin | 273/67 C |
| 1,554,508 | 9/1925 | Kaiser | 273/68 |
| 1,564,208 | 12/1925 | Connolly | 273/80 A |
| 1,577,159 | 3/1926 | Barrett | 273/80 B |
| 1,950,342 | 3/1934 | Meshel | 273/81 R |
| 1,974,389 | 9/1934 | Cowdery | 273/80 R |
| 1,983,074 | 12/1934 | Durell | 273/80 R |
| 1,994,069 | 3/1935 | Fletcher | 273/80 R |
| 2,001,643 | 5/1935 | Wilcox | 273/80.3 X |
| 2,037,636 | 4/1936 | Lagerblade | 273/80 R |
| 2,066,962 | 1/1937 | Cross | 273/80 A |
| 2,078,728 | 4/1937 | Lard | 273/80 B |
| 2,085,915 | 7/1937 | Mac Callum | 273/80 R |
| 2,130,395 | 9/1938 | Lard | 273/80 B |
| 2,236,414 | 3/1941 | Reach | 273/80 B |
| 2,809,144 | 10/1957 | Grimes | 273/80 B |
| 2,822,175 | 2/1958 | Redmond | 273/80.4 |
| 3,087,728 | 4/1963 | Pond | 273/67 R |
| 3,206,205 | 9/1965 | McLoughlin | 273/80 B |
| 3,368,257 | 2/1968 | Andreasson | 29/106 |
| 3,502,124 | 3/1970 | Mater | 144/13 |
| 3,606,326 | 9/1971 | Sparks et al. | 273/81 R |
| 3,738,765 | 6/1973 | Mater | 408/37 |
| 3,854,838 | 12/1974 | Barnett et al. | 408/59 |
| 3,871,649 | 3/1975 | Kilshaw | 273/77 A |
| 4,119,388 | 10/1978 | Armitage | 408/11 |
| 4,165,874 | 8/1979 | Lexatte | 273/80 B X |
| 4,205,845 | 6/1980 | Kanne | 273/80 B |
| 4,288,075 | 9/1981 | Kaugars et al. | 273/80 B |
| 4,470,600 | 9/1984 | Parente et al. | 273/80 B |

FOREIGN PATENT DOCUMENTS

| | | | |
|---|---|---|---|
| 20726 | of 1908 | United Kingdom | 273/80 R |
| 296225 | 8/1928 | United Kingdom | 273/80 R |
| 327720 | 4/1930 | United Kingdom | 273/80 R |
| 555027 | 7/1943 | United Kingdom | 273/80 R |

*Primary Examiner*—George J. Marlo

*Attorney, Agent, or Firm*—Duane C. Bowen

[57] ABSTRACT

A golf club shaft having a bored outer wood hollow tube and having an inner non-wood hollow tube positioned inside and closely fitting the interior bore of the outer tube. An adhesive between the tubes bonding them together. The inner tube having at least one step increasing its exterior diameter and creating an upper larger diameter portion above the step that is less flexible and creating a lower lesser diameter portion below the step that is more flexible. The outer wood tube being counter-reamed creating a portion of greater interior diameter matching the location of the less flexible upper portion of the inner tube above the step and leaving a portion of lesser diameter not counter-reamed matching the location of the more flexible portion of the inner tube below the step.

8 Claims, 8 Drawing Figures

GOLF CLUB SHAFT

This is a continuation-in-part of a prior application by the same inventors, Ser. No. 386,931, filed 6/10/82, now U.S. Pat. No. 4,470,600. Reference to the prior application is made for the background material.

BRIEF SUMMARY OF THE INVENTION

Objectives and Background

Our invention concerns a golf club shaft having an outer wood tube and an inner stepped tube therein made out of metal or other suitable non-wood material.

Objectives of our invention are to improve a golf club in respect to the following:

(a) To reduce radial torque or twisting of club head and shaft that is aggravated by off-center hits of the ball by the head.

(b) To reduce downswing flexing or bending of the shaft in downswing prior to ball impact. Less flexing will mean less distance for the club head to travel to recover normal club disposition in which the axis of the shaft is a straight line.

(c) To reduce flexing, twisting or bending of the shaft past the recovered position, i.e., after recovery. The more the shaft flexes during the upswing past the recovered position the more the shaft flexing adds loft to the club face and the more the head and shaft twist which misaligns the club face to the right thereby deflecting the ball to the right.

(d) To reduce flexing of the shaft in the nature of club-head toeing caused by centrifugal force that makes the toe of the club head hit the ground before the heel.

(e) To reduce club vibrations as the ball is struck in general and to dampen the harsh vibrations particularly caused by off-center hits, by hard-covered balls, by cold weather conditions, by cast steel heads, and by other deficiencies in club constructions.

Further objectives common to the prior application include: to improve a golf club in the foregoing respects while maintaining the weight thereof at about the level of clubs with conventional shafts; to provide a club of improved feel; to devise a way to satisfactorily bore the wood part of the shaft; to provide an improved golf club in various aspects of flexing, twisting end vibration while maintaining other desirable characteristics of conventional golf clubs; to devise an attractive club having the appearance of a wood shaft while providing suitable economy of manufacture considering the quality of the product and while providing suitable durability; and to provide a golf club shaft with the appearance and softer feel of wood, especially hickory, and with the reliability and consistency of steel.

It has been found that a club shaft with a stepped inner non-wood tube, having a larger O.D. in its upper portion and having a smaller O.D. in its lower portion, will have physical properties in at least some clubs (and perhaps in all clubs) that will be deemed preferable over non-stepped inner tubes by at least some players (and perhaps by most well informed players). Use of such a stepped inner tube will result in increased flexibility in the lower part of the club and relatively less flexibility in the upper part of the club, as compared to use of a non-stepped inner tube. It is an objective of our invention to achieve such a differential in flexibility, which is generally considered to be desirable in golf club shafts, and it is a further objective to achieve such differential by one or more steps in the O.D. of the inner non-wood tube. Another objective is to provide such a stepped construction in a club shaft feasible to manufacture when made with an outer wood tube and with an inner non-wood tube made from material such as metal or graphite, considering particularly the great difficulty in boring wood with needed dimensions and within needed tolerance in golf club shaft manufacture.

In the course of our work we have found forming tapered bores in wood, with needed dimensions and within needed tolerances, is not feasible. Another objective is to manufacture the type of composite golf club shaft described, increasing flexibility of the lower golf club shaft portion and relatively decreasing the flexibility of the upper golf club shaft portion, without tapering the wood tube bore but rather by boring and counter-remaining the wood tube to achieve a stepped construction.

Our invention will be best understood, together with additional advantages and objectives thereof, when read with reference to the drawings.

THE DRAWINGS

GENERAL DESCRIPTION

Figure 1:
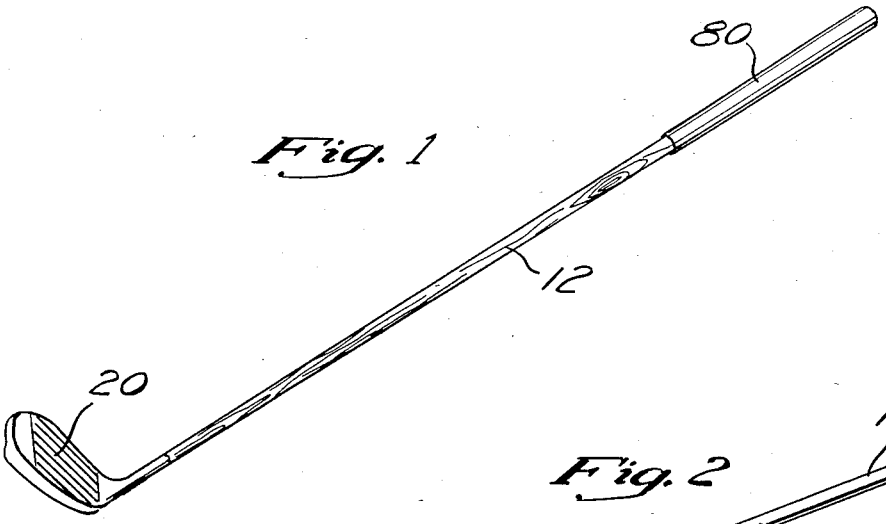
FIG. 1 is a perspective view of a golf club embodying our new invention.
Figure 2:
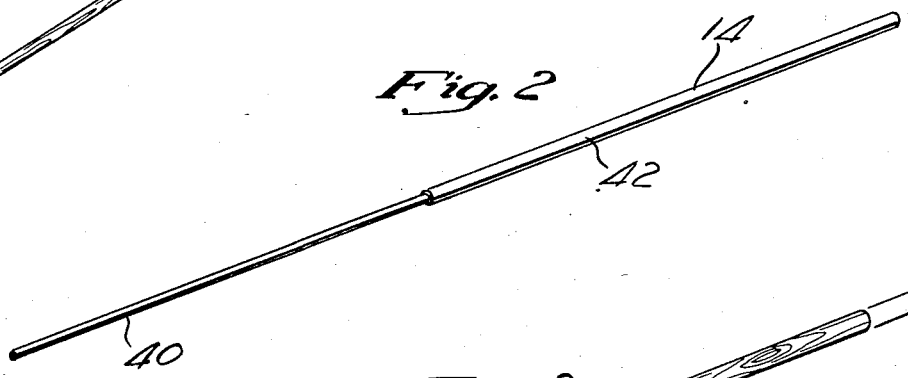
FIG. 2 is a perspective view of an inner non-wood tube.

Our invention includes preferably the use of a true hickory shaft with a specially designed thin-walled, light-weight steel or graphite liner down the center. The combination of hickory and steel or graphite produces a more playable shaft than has been known previously in the art. A club shaft made according to our invention, of all head types and sizes, has the reliability, consistency and playability of steel or graphite along with the looks and feel of hickory. The harsh feel of investment cast irons and of balls with hard coverings can be greatly reduced by this "hickory stick". The natural wood absorbs harsh vibrations and produces a soft feel golfers liked before the advent of steel shafts. The combined hickory-steel shaft produces unique flex characteristics and low torque which results in a more accurate shaft than has been known previously in the art. Several designs of heads have been used to complement the hickory-steel shaft. Such head designs and their methods of attachment to the shaft are not described or shown herein as they were shown and described in our prior referenced patent application. A leather grip 80 also may be used as an associated high quality detail. A shaft or extender may be used at the upper end of the shaft but is not described or shown herein because of disclosure in our prior reference patent application.

An outer solid wood tube 10 of the golf club shaft 12 preferably is made of hickory but may be made of other wood. A Markush expression for a preferred list of woods is a material selected from the group consisting of hickory, ash, and birch.

An inner rigid thin-walled non-wood tube 14 of shaft 12 is positioned inside of and closely fits the interior of outer tube 10. Inner tube 14 preferably is formed of chrome-moly steel or graphite. A Markush expression for a preferred list of materials for inner tube 14 is a material selected from the group consisting of chrome-moly steel, other steel alloys, aluminum, bonded graphite fibers, bonded boron fibers, and bonded fiberglass fibers.

An adhesive 23 preferably is used between the interior of outer tube 10 and the exterior of inner tube 14. A preferred adhesive is an epoxy.

In order for a golf club shaft 12 to be workable, which is laminated by an outer wood tube 10 and an inner non-wood tube 14, the two tubes must be closely fitting, meaning that tolerances of manufacturing must be suitably controlled. An example of dimensions and tolerances without stepping would be in order of 0.370±0.002" OD for tube 14 and 0.375±0.004" zero ID for tube 10. Working with such tolerances is no special problem with the non-wood materials above specified for inner non-wood tube 14. Tolerances of that order are common and particularly with metals.

The problem is in boring wood for outer tube 10 with tolerances such as are given above. Early experiments indicated, in fact, that it was impossible to maintain such tolerances. Prior long bore wood drills, used in drilling wood lamp standards and the like, did not hold tolerances and were particularly bad in wandering of the drill centers. Without controlled tolerances, the combined wood-metal shaft was impossible. The closely desired tolerances of the ID of wood tube 10 became possible only when we arrived at certain special boring techniques, which have proven to produce tubes within the tolerances needed, including the following:

(a) We use a larger block or cylinder of wood and only after the interior is bored do we then turn the exterior on a lathe to produce the desired exterior surface. It will be understood that the interior tolerances are the critical problems first because the interior tolerances mate with the inner tube 14 and second because holding close tolerances in exterior tolerances in turning wood is not a severe problem, for example. We routinely turn the larger block or cylinder to ±0.005" tolerances after achieving satisfactory interior boring. Using the larger block or cylinder decreases the problem of deflection of the material during boring. An example, is to start with a preturned ¾" hickory dowel and to bore a 0.375 bore ±0.004" zero. A patent to Stolle U.S. Pat No. 1,513,350, Page 4, lines 112–130, describes boring wood before turning the same, however, in the prior patents.

(b) We conceived of the use of a riflebore drill to produce the bore in tube 10. Greatly improved results were achieved from use of this precision drilling instrumentality. A preliminary examination search herein disclosed the U.S. Pat. No. 1,513,350 to Stolle, however, in which the patentee described using riflebore drilling machines manufactured by Pratt & Whitney and by Baush Machine Tool to drill bobbins and spools and to drill reinforced peavey and hammer handles, whiffle-trees, etc.

(c) We prefer to use forced air to carry chips away from the drill. The air also has some cooling or lubricating functions. The preliminary examination search herein disclosed prior use of air to dispose of wood chips in boring, however, i.e., Mater U.S. Pat. Nos. 3,502,124 and 3,738,765 and Barnett U.S. Pat. No. 3,854,838 in boring poles upward of forty feet in length and in boring hydro poles.

(d) In order to obtain the precision needed in boring we have found it important to adopt an engine lathe for boring operations.

Our experience is that the use of these measures (a), (b), (c) and (d) has produced bored tubes 10 within tolerances at a minimal rejection rate.

Figure 3:
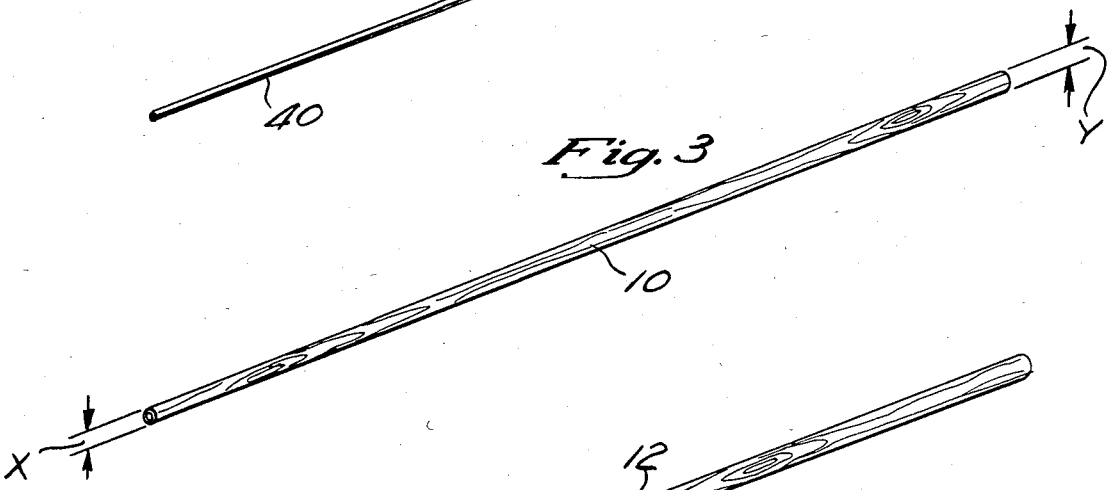
FIG. 3 is a perspective view of an outer wood tube.
Figure 4:
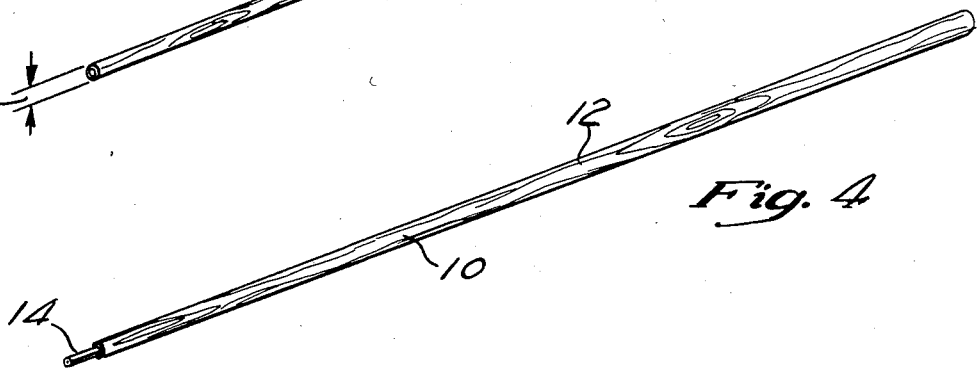
FIG. 4 is a perspective view of a club shaft without club head.
Figure 5:
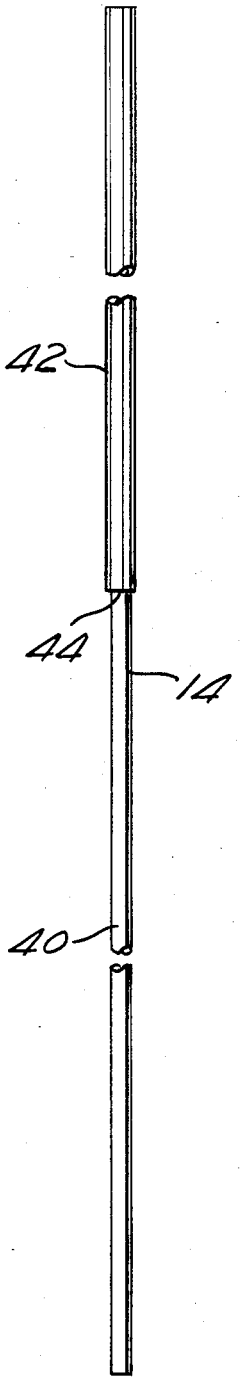
FIG. 5 is a side view of the inner tube shown in FIG. 2 on larger scale. It will be understood the view has portions broken away in order to reduce length of the tube in the view.

Moisture conditions are important in wood which can swell or contract depending on moisture content. Either relative humidity should be controlled between the time of boring of tube 10 and the time of laminating of tube 14 therein or the lamination process should be conducted very soon after boring of relative humidity is not controlled. The exterior of shaft 12 and outer tube 10 tapers from the upper to lower ends, i.e., dimension "y" in FIG. 3, is larger than dimension "x".

Usually tube 10 will be fabricated from standard wood dowel stock. However, we do not want to state it would be impossible to fabricate tube 10 from a laminated block of wood, although at present it seems the natural solid block of wood is preferable.

Wood tube 10 can be turned down to a small diameter like that in steel clubs, and a rubber or leather grip 80 can be used, which is preferred by most players. Extensions can be applied to the upper end of club shaft 12. A golf club head 20 is secured to the lower end of club shaft 10. Use of rubber or leather grips 80 or use of extensions and the subject of connecting club head 20 to club shaft 12 will not be illustrated or described herein as they were adequately covered in the prior referenced patent application Ser. No. 386,931 and they have no special relationship to the subject of a stepped shaft, which is the special added feature of this patent application.

The lamination of materials in outer tube 10 and inner tube 14 bonded together, such as hickory and light-weight thin walled steel tubing or graphite epoxied together, produces a golf club shaft 12 of exceptional strength and dampening abilities, while maintaining a light-weight shaft. Some of the physical characteristics will be reviewed below.

One property is radial torque about the longitudinal axis of the club shaft. During swing and particularly ball impact, and especially due to off-center hits, club shafts tend to twist about their longitudinal axes. With our laminated shaft, the angular twisting or torsion is believed to be very considerably less than with a conventional steel club shaft. To give an example, one of our shafts was tested as to angular deflection under torsion against a comparable conventional steel shaft with the same conditions of weight, moment, arm, etc. The conventional steel shaft deflected 4–6 degrees and our laminated shaft deflected 2–3 degrees. Excessive torsion particularly in off-center hits can cause particularly bad shots, especially slices.

Another property concerns flexing or bending about lateral axes in downswing prior to impact. The conventional shaft has more bending in downswing than our laminated shaft. With less flexing in our shaft, the club has to travel less arcuate distance, relative to a straight line representing the longitudinal axis of the shaft in the ideal, non-flexed condition. In the ideal, never realized condition of a club, there would be no bending or twisting of the shaft and the club head would have the ideal relationship to the ball, which is the basis for club head design. This is not to say that absolutely no flexing or twisting would be desirable as complete rigidity might not feel good, but it is to say that less flexing and twisting of the shaft as compared with a conventional steel shaft is highly desirable in producing better shots.

Another property concerns conditions after the club head and shaft have been recovered after the down swing. The club head and shaft flex or bend past a fully recovered position (in which the axis of the shaft is on a straight line). The club head and shaft also twist and loft is added to the club face. The twisting misalignment is to the right, opening up the club face, a condition tending to cause slicing. Such bending of the shaft, lofting of the club face, and twisting of the club face are greatly reduced in our laminated shaft as compared to prior conventional steel shafts.

Another property concerns flexing caused by centrifugal force that makes the club head toe hit the ground before the club head heel. This flexing could be said to be generally in planes common to the club shaft and the player and at right angles to the plane of the swing whereas the flexing in downswing and after recovery, described above, could be said to be generally in the plane of the swing and at right angles to the planes common to shaft and player. Such flexing in said common planes changes the disposition of the face of the club head from as ideal disposition to one somewhat misaligned. Such flexing is reduced with our laminated shafts as compared with conventional steel shafts.

Another property deals with vibration and indicates our laminated shaft has a reduced level of vibrations as compared to conventional steel shafts. Our laminated shaft, perhaps particularly because of the solid wood, acts as a shock absorber dampening harsh vibrations caused by off-center hits, hard-covered balls, cold weather, cast steel heads, etc.

Stepped Shaft

In the previous patent application Ser. No. 386,931, the members 10,14 forming shaft 12 were not described as stepped. The description specified a constant O.D. and I.D. for inner non-wood tube or liner 14 and a constant I.D. for wood tube 10. A desirable characteristic of golf clubs is to have more flexibility in the lower shaft and more rigidity in the upper shaft, as can be obtained by tapering. In connection with FIG. 3, the O.D. of wood tube 10 has been described as tapering from dimension "Y" to dimension "X".

However, there was no way to produce a tapered bore in wood tube 10. As detailed above, it is extremely difficult to obtain even a straight bore in wood tube 10, much less to think of making a flared bore. Even though we have defined a combination of manufacturing techniques that can be used to produce a bore in wood tube 10 within tolerances, production is still tedious. If a tapered I.D. can't be produced in wood tube 10, of course the O.D. of non-wood tube 14 has to be constant, within close tolerances.

As to the I.D. of non-wood tube 14, manufacturing techniques for metal or graphite tubes, for example, would permit tapering or even a step but such change in dimensions close to longitudinal axis of shaft 12 insufficiently differentiate flexibility of upper and lower portions of shaft 12.

Figure 8:
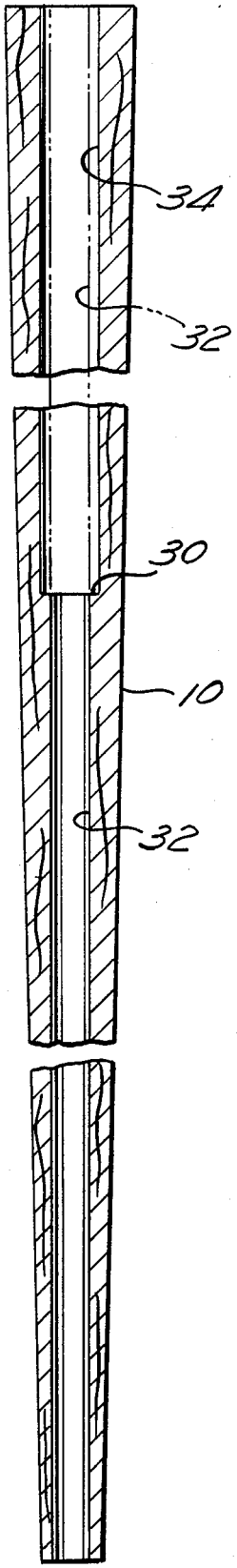
FIG. 8 is an enlarged longitudinal sectional view of the outer tube shown in FIG. 3.

It has been perceived, however, that although tapering of the I.D. of wood shaft 10 is not feasible, stepping of the I.D. of wood shaft 10, with one or more steps 30 is feasible. The step is formed after the uniform internal diameter bore 32 is made. In FIG. 8 the bore 32 is shown in full lines except at the upper portion where the original bore 32 is shown in dashed lines. The step 30 and the increased internal diameter bore 34 is accomplished by counter-reaming in a later operation, i.e., going back in a reaming operation to increase the bore from the original I.D. 32 to the enlarged I.D. 34 and thereby creating step 30. For examples, the original I.D. 32 might be 0.375" and the reamed I.D. 34 might be 0.395". There may be more than one step 30. If there is only one step 30, an example is a location 16" to 18" from the lower end of wood tube 10. Such step 30 may be said to be located in the central portion of tube 10 rather than in the end portions of tube 10.

The O.D. of non-wood tube 14 is increased in corresponding areas and with corresponding dimensions. If the normal I.D. 32 of tube 10 were 0.375±0.004" zero and of the increased diameter I.D. 34 of tube 10 were 0.395±0.004" zero, then suitable O.D.'s of non-wood tube 14 would be a smaller O.D. 40 of 0.370±0.002" and a large O.D. 42 of 0.390±0.002" creating a step 44. Creating O.D.'s of such dimensions and tolerances in metal or in a non-metal like graphite, of course are easily accomplished.

Figure 6:
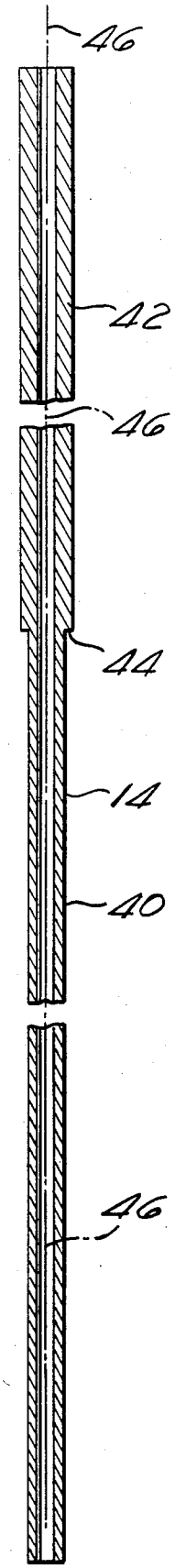
FIG. 6 is an enlarged longitudinal sectional view of the inner tube shown in FIG. 2.
Figure 7:
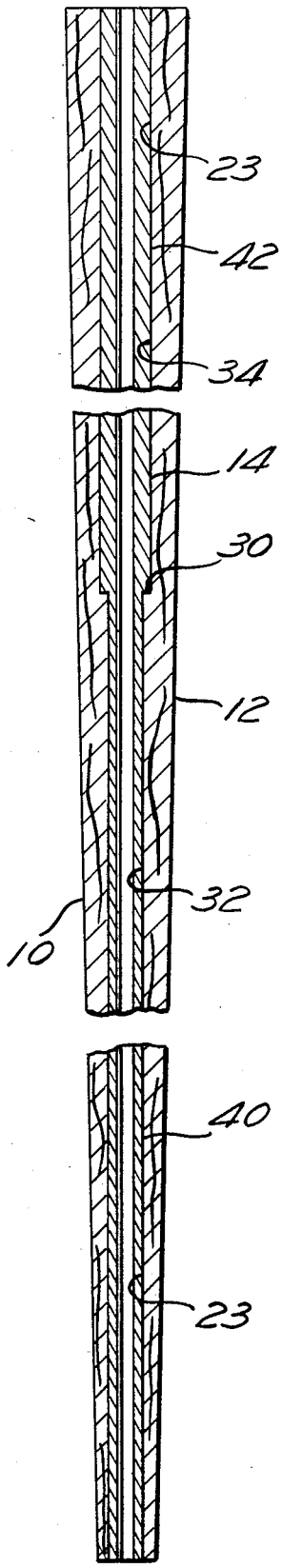
FIG. 7 is an enlarged longitudinal sectional view of the shaft shown in FIG. 4.

A typical wall thickness of non-wood tube 14 in the club before stepping, in area 40, has been around 0.014" to 0.015". After stepping, a typical wall thickness of non-wood tube 14 in the club, in area 42, is around 0.024" to 0.025". The point is not only the increase in wall thickness but also that the increase is on the outside of tube 14, the O.D. 42, rather than on the inside, the I.D., because the increase of O.D. is farther from the longitudinal axis 46 than an increase in I.D., as will be observed from FIG. 6. Therefore, the increase in O.D. dimension of tube 14 adds more rigidity to the club shaft 12 than if the same amount of material were added to the bore of tube 14 closer to longitudinal axis 46.

Having thus described our invention, we do not wish to be understood as limiting ourselves for the exact construction shown and described. Instead, we wish to cover those modifications of our invention that will occur to those skilled in the art upon learning of our invention and which are within the proper scope thereof.

We claim:

1. A golf club shaft, comprising:

(a) an outer wood hollow tube having an interior bore from end to end, said wood tube tapering in its exterior diameter from its upper end to its lower end, (b) an inner non-wood hollow tube positioned inside and closely fitting the interior of said outer tube throughout at least the major extent of the length of said outer tube, (c) an adhesive between the interior bore of said outer tube and the exterior of said inner tube bonding them together, (d) said inner non-wood tube having at least one step up in exterior diameter between its lower portion and its upper portion providing a less flexible portion above said step and a more flexible portion below said step, said less flexible portion having a uniform exterior diameter throughout at least the major extent of the length of said less flexible portion and said more flexible portion having a uniform exterior diameter throughout at least the major extent of the length of said more flexible portion, (e) said outer wood tube being counter-reamed and creating a portion of greater interior diameter matching the location of said less flexible portion of said inner tube above said step and leaving a portion of lesser interior diameter not counter-reamed matching the location of said more flexible portion of said inner tube below said step, said portion of greater interior diameter having a uniform interior diameter at least the major extent of the length thereof, said portion of lesser interior diameter having a uniform interior diameter throughout at least the major extent of the length thereof.

2. A golf club shaft, comprising:

(a) an outer wood hollow tube having an interior bore from end to end, said wood tube tapering in its exterior diameter from its upper end to its lower end, (b) and inner non-wood hollow tube positioned inside and closely fitting the interior of said outer tube throughout at least the major extent of the length of said outer tube, (c) said inner non-wood tube having at least one step up in exterior diameter between its lower portion and its upper portion providing a less flexible portion above said step and a more flexible portion below said step, said less flexible portion having a uniform exterior diameter throughout at least the major extent of the length of said less flexible portion and said more flexible portion having a uniform exterior diameter throughout at least the major extent of the length of said more flexible portion, (d) said outer wood tube being counter-reamed and creating a portion of greater interior diameter matching the location of said less flexible portion of said inner tube above said step and leaving a portion of lesser interior diameter not counter-reamed matching the location of said more flexible portion of said inner tube below said step, said portion of greater interior diameter having a uniform interior diameter at least the major extent of the length thereof, said portion of lesser interior diameter having a uniform interior diameter throughout at least the major extent of the length thereof.

3. The subject matter of claim 2 in which said inner tube is formed from a material selected from the group consisting of chrome-moly steel, other steel alloys aluminum, titanium, bonded graphite fibers, bonded boron fibers, bonded graphite-boron fibers, and bonded fiberglass fibers.

4. The subject matter of claim 2 in which said inner tube is formed of chrome-molysteel.

5. The subject matter of claim 2 in which said inner tube is formed material including graphite fibers.

6. The subject matter of claim 2 in which said outer tube is formed from a material selected from the group consisting of hickory, ash and birch.

7. The subject matter of claim 2 in which said outer tube is formed from hickory.

8. A golf club shaft, comprising:

(a) an outer wood hollow tube having an interior bore from end to end, said wood tube tapering in its exterior diameter from upper end to lower end, (b) and inner non-wood hollow tube positioned inside and closely fitting the interior of said outer tube throughout at least the major extent of the length of said outer tube, (c) said inner non-wood tube having at least one step up in exterior diameter between its lower portion and its upper portion providing a less flexible portion above said step and a more flexible portion below said step, said less flexible portion having a uniform exterior diameter throughout at least the major extent of the length of said less flexible portion and said more flexible portion having a uniform exterior diameter throughout at least the major extent of the length of said more flexible portion, and (d) said outer wood tube having a portion of greater interior diameter matching the location of said less flexible portion of said inner tube above said step and said outer wood tube having a portion of lesser interior diameter matching the location of said more flexible portion of said inner tube below said step, said portion of greater interior diameter having a uniform interior diameter throughout at least the major extent of the length thereof, said portion of lesser interior diameter having a uniform interior diameter throughout at least the major extent of the length thereof.

* * * * *